United States Patent [19]

Quittner

[11] Patent Number: 4,500,225

[45] Date of Patent: Feb. 19, 1985

[54] TRANSFERABLE ROADWAY LANE DIVIDER

[75] Inventor: John P. Quittner, Castle Cove, Australia

[73] Assignee: Quicksteel Engineering Pty. Ltd., Botany, Australia

[21] Appl. No.: 485,622

[22] Filed: Apr. 18, 1983

Related U.S. Application Data

[63] Continuation-in-part of Ser. No. 344,755, Feb., 1982.

[51] Int. Cl.[3] ..... E01F 13/00

[52] U.S. Cl. ..... 404/6; 404/13

[58] Field of Search ..... 404/6, 13, 14, 12, 9, 404/72; 256/13.1

[56] References Cited

U.S. PATENT DOCUMENTS

| | | | |
|---|---|---|---|
| 1,683,121 | 9/1928 | Baldwin | 404/13 |
| 2,931,279 | 4/1960 | Wiswell | 404/13 |
| 3,263,578 | 8/1966 | Pilcher | 404/13 |
| 3,326,099 | 6/1967 | Cova | 404/13 X |
| 3,636,910 | 1/1972 | O'Brien | 404/6 X |
| 3,958,890 | 5/1976 | Ferrari | 404/72 X |
| 4,017,200 | 4/1977 | Woods | 404/6 |
| 4,376,594 | 3/1983 | Prosenz | 404/13 X |

*Primary Examiner*—Stephen J. Novosad
*Assistant Examiner*—Bruce M. Kisliuk
*Attorney, Agent, or Firm*—Phillips, Moore, Lempio & Finley

[57] ABSTRACT

A roadway lane divider comprises a plurality of interconnected divider sections each having a T-shaped upper end. Rollers of a mobile transfer apparatus are adapted for engagement under a pair of longitudinally extending undercut bearing surfaces, defined on the upper end of each divider section, to lift and suspend the divider sections as a unit on a first side of the apparatus, move them serpentine-like across the apparatus and deposit the divider sections on a second, opposite side of the apparatus.

13 Claims, 5 Drawing Figures

TRANSFERABLE ROADWAY LANE DIVIDER

CROSS-REFERENCE TO RELATED APPLICATION

This patent application is a continuation-in-part of my co-pending U.S. patent application, Ser. No. 344,755, filed on Feb. 1, 1982.

TECHNICAL FIELD

The present invention relates to a system of transferable roadway lane dividers and a method of transferring said dividers. Such a system is necessary due to the flapping of roadway dividers on bridges and major roads during peak hours.

BACKGROUND ART

The existing method of moving lane markers consists of manually picking up the originally placed markers and manually placing the markers into the new positions. This particular job is somewhat dangerous for the people physically moving the lanes and also requires several people to successfully carry out the operation. The present invention overcomes these problems by providing a transferable lane divider which can be moved by an appropriate transfer mechanism located on a special vehicle.

DISCLOSURE OF INVENTION

In one broad form the invention comprises a transferable roadway lane divider comprising divider sections which are adapted to be hingedly connected to adjacent sections for form a divider separating traffic lanes, said sections each having means whereby they can be picked up by a transfer device and slid along the transfer device to be repositioned.

In another form the invention comprises a method of transferring road lane dividers which dividers comprise a plurality of individual sections pivotally joined together, said method comprising the steps of lifting at least one of said sections and feeding said sections along an elongated transfer device and depositing said lane divider sections in their new position.

BRIEF DESCRIPTION OF THE DRAWINGS

The invention will now be described by way of example with reference to the accompanying drawings in which.

BEST MODE OF CARRYING OUT THE INVENTION

Each lane divider is made up of individual sections 1 which are hingedly joined together on a pair of links 2.

The required number of sections 1 are joined together to form any suitable length of divider. Each end may contain a shaped section having only one pair of hinge attachments and a substantially bullet shaped other end.

Figure 1:
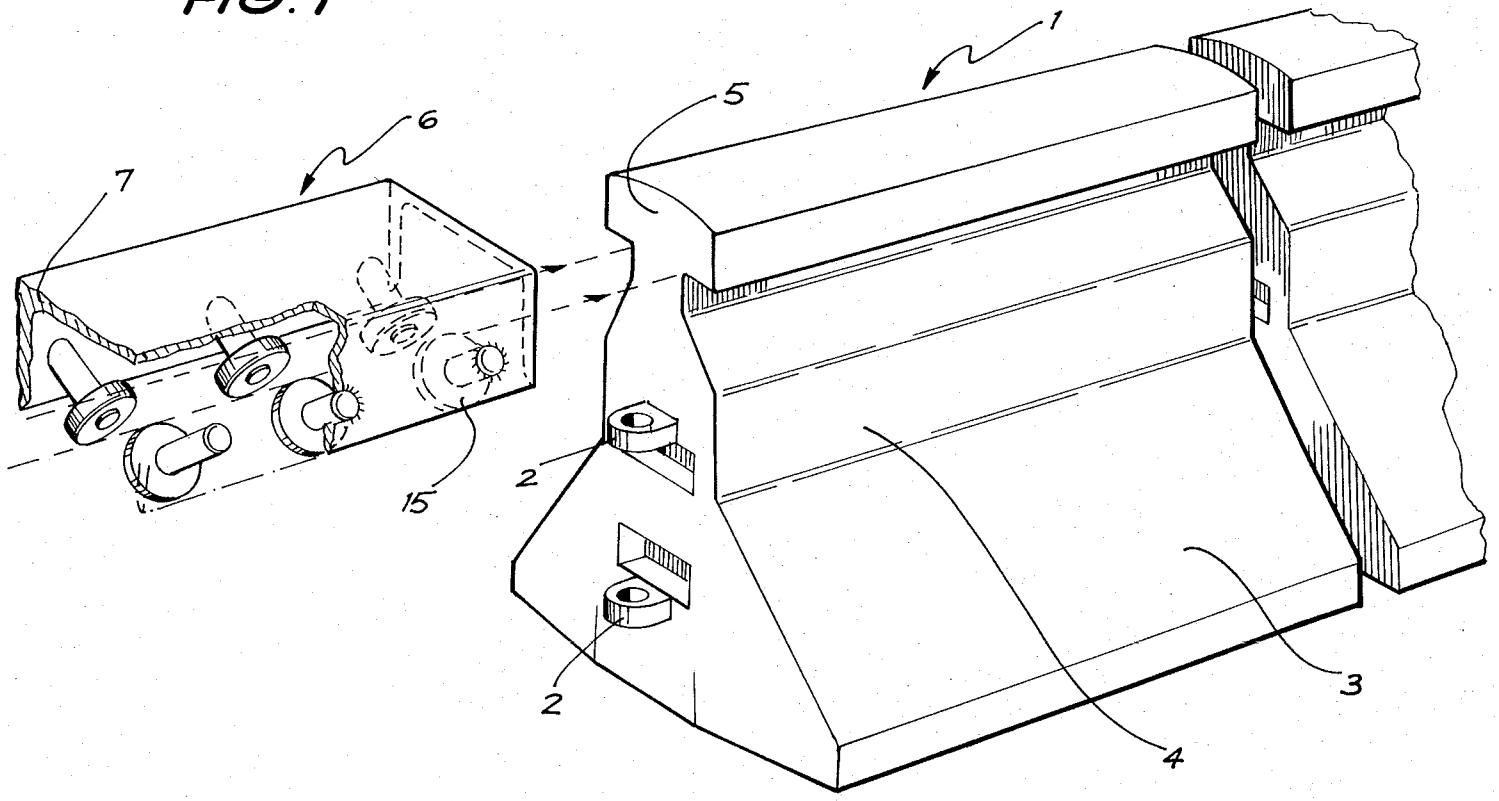
FIG. 1 shows the lead divider section and adjacent section of an embodiment of the present invention and the position of the load in end of a transfer device of an embodiment of the present invention.

The divider sections 1 can be shaped as shown in FIG. 1 in which each section has two sloping sides 3 to provide a smooth surface in case a motorist's tire accidentally runs into the divider.

A center section 4 extends upwardly from the sides 3 to provide a substantial barrier which is readily visible. Preferably the divider section is 800 mm in height by 600 mm in width and approximately 1 meter in length.

However any suitable dimensions would be acceptable provided suitable stability for the divider.

The sections of the lane divider can be made of any suitable material such as concrete or plastics or sheet metal.

Preferably the sections are constructed of reinforced concrete with the respective hinges on opposite ends of a section being formed on the one bar of metal, with the reinforcing rods positioned to give suitable strength.

Figure 5:
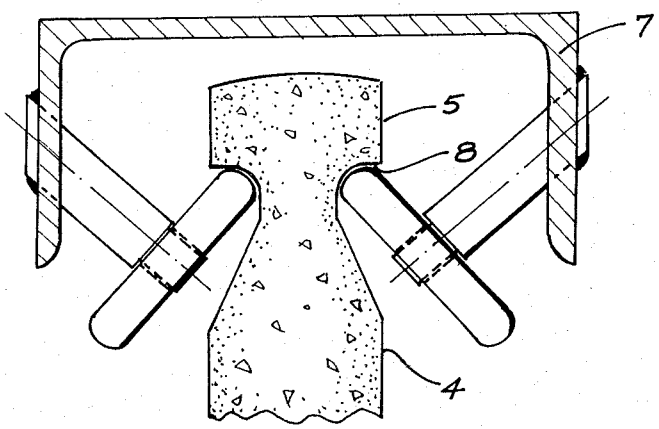
FIG. 5 illustrates the engagement of the rollers of a transfer device with a divider section.
Figure 4:
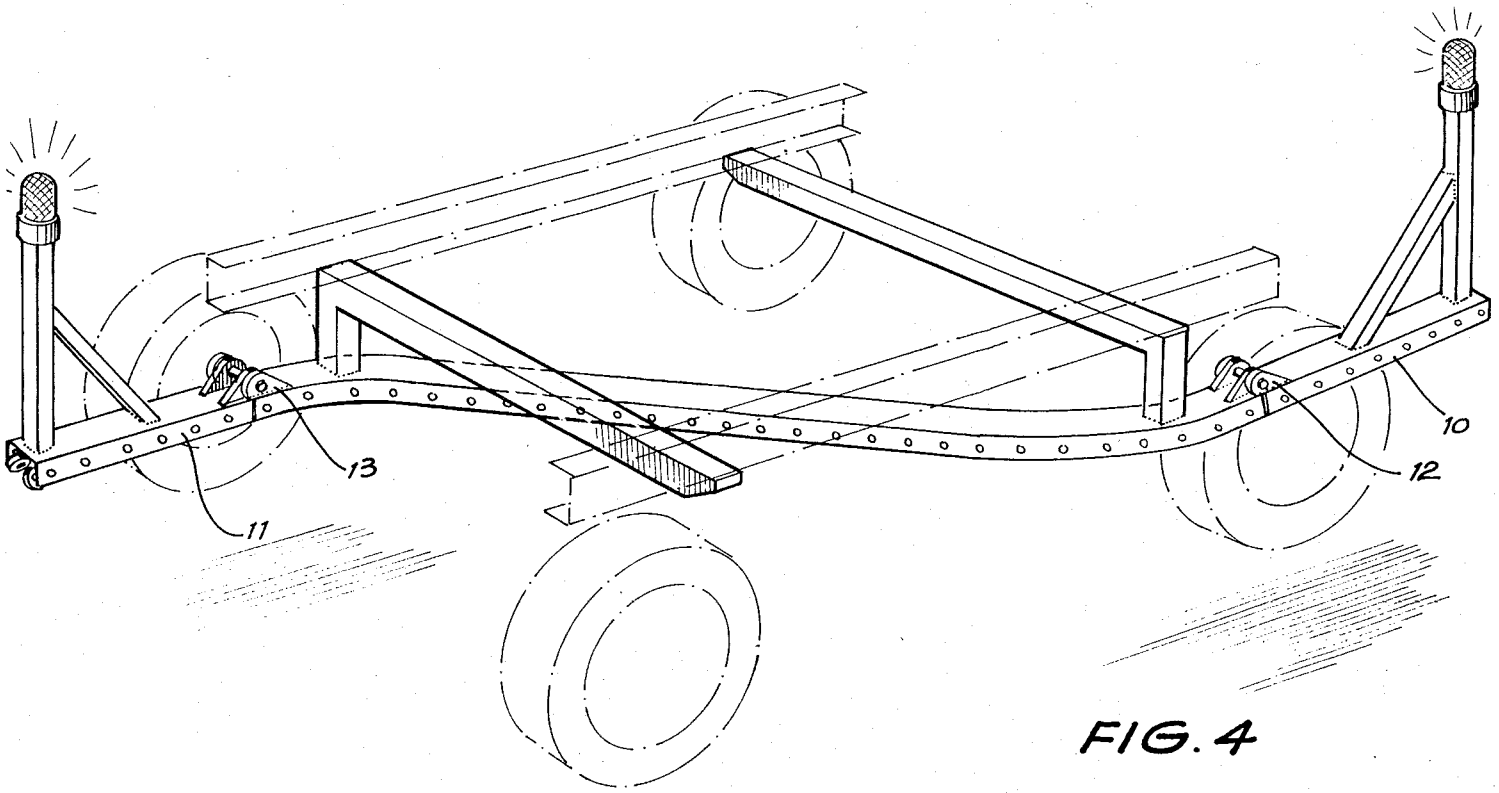
FIG. 4 illustrates schematically the position of a transfer device mounted on a trailer, according to an embodiment of the present invention.

To facilitate in moving the lane divider each section has a T-shaped projection 5 extending from the center section 4 and running longitudinally along the divider. To transfer the lane divider, a transfer mechanism as shown in FIG. 4 can be used. This comprises a roller conveyer 6 comprising a series of rollers angularly attached to the channel 7 as shown in FIGS. 1 and 5. Each roller is positioned so as to engage with radius at the neck of the T as shown at 8 in FIG. 5.

Figure 2:
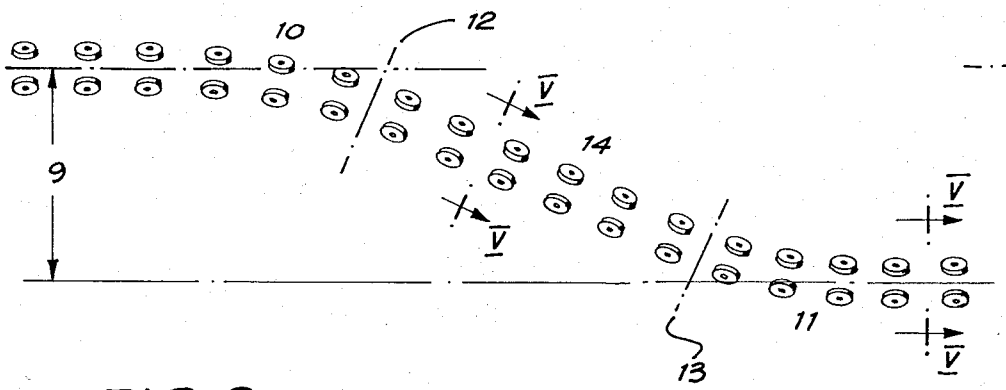
FIG. 2 shows a schematic representation of the roller assembly of one embodiment of the transfer device.

Basically the transfer mechanism is s-shaped as shown schematically in FIG. 2 with its total width 9 corresponding with the distance between traffic lanes. It can preferably be mounted, as shown schematically in FIG. 4, from below a trailer. The front section 10 and the rear section 11 are preferably hinged at pivots 12 and 13 such that they can hinge back to the body of the trailer to keep within the allowable width for travel on the road. The straight center section 14 can be telescoped in and out to achieve variable lane widths.

To move the lane divider from one side of the lane to the other, one simply drives the vehicle with the transfer mechanism mounted beneath or towed behind on a trailer, and engages the leading rollers 15 beneath the T-shaped projection 5.

As the transfer mechanism is moved along the lane the lane dividers are threaded along the roller conveyor 6 and are deposited by the rear section 11 on the other side of the lane.

Preferably the vehicle or trailer carries the channel underneath the wheels with the mouth extending on one side of the vehicle with the outlet extending on the other side of the vehicle such that the vehicle can drive the center of the lane to reposition the lane divider. However in certain circumstances it may be necessary for the channel to be positioned in other relationships with respect to the vehicle.

Figure 3:
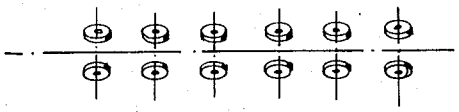
FIG. 3 shows schematic representation of the roller assembly of an aligning device for straightening up the lane dividers if they are accidentally knocked out of position.

FIG. 3 shows an aligning mechanism useable to straighten out the lane divider in cases where the lane divider is accidentally knocked out of position by a vehicle or other circumstances.

It should be apparent to people skilled in the art that the invention is not only limited to the specific disclosure detailed herein but is broad enough to cover obvious variations without departing from the spirit of the invention.

The claims defining the invention are as follows:

1. A transferable roadway lane divider comprising at least one upstanding divider section having a base and a T-shaped upper end, said divider section being sufficiently high to form a crash barrier for automobiles and the like, and transfer means formed in unobstructed relationship on lateral sides and longitudinally throughout the entire length of the T-shaped upper end of said divider section for receiving and engaging a transfer apparatus to enable said divider section to be lifted and suspended for transfer on a roadway.

2. The lane divider of claim 1 further comprising connecting means on each end of said divider section for pivotally connecting said divider section to next adjacent divider sections.

3. The lane divider of claim 1 wherein said transfer means comprises a pair of laterally spaced undercut bearing surfaces formed on the upper end of said divider section to extend longitudinally throughout the entire length thereof and positioned to receive and engage said transfer apparatus thereunder.

4. The lane divider of claim 3 wherein the base of said divider section is substantially wider than the upper end thereof and wherein said bearing surfaces are defined on undersides of a pair of horizontally disposed flanges further disposed in lateral alignment on the upper end of said divider section to extend away from each other.

5. The lane divider of claim 4 wherein said divider section essentially comprises reinforced concrete and said base has an at least generally flat bottom surface constructed for surface mounting on said roadway.

6. The lane divider of claim 1 or 3 comprising a plurality of said divider sections disposed in closely spaced and tandem relationship relative to each other and connecting means for interconnecting each adjacent pair of divider sections together for permitting them to pivot laterally relative to each other and to maintain the transfer means of said divider sections in alignment to permit them to be lifted and moved serpentine-like as a unit above and across said roadway by said transfer apparatus.

7. The lane divider of claim 6 further comprising a mobile road vehicle having a transfer apparatus comprising a generally S-shaped conveyor means for sequentially engaging the transfer means of said divider sections to lift and suspend said divider sections as a unit above said roadway at a first position adjacent to a first end and a first lateral side of said transfer apparatus, move said suspended divider sections as a unit serpentine-like generally transversely from said first position to a second position adjacent to a second end and a second lateral side of said transfer apparatus, opposite to said first lateral side, and deposit said divider sections as a unit on said roadway.

8. The lane divider of claim 7 wherein said conveyor means comprises a generally S-shaped support member extending from said first position to said second position and a plurality of roller means mounted on said support member for engaging beneath the transfer means of each of said divider sections.

9. A method for transferring a roadway lane divider from a first position to a laterally displaced second position on a roadway or the like, said lane divider comprising a plurality of interconnected divider sections positioned in free-standing relationship on said roadway and disposed in closely spaced tandem relationship relative to each other, each divider having a T-shaped upper end defining a pair of laterally spaced bearing surfaces on outer sides thereof and being sufficiently high to form a crash barrier for automobiles and the like, said method comprising the steps of positioning a mobile transfer apparatus adjacent to a first end of said lane divider, engaging said transfer apparatus beneath said laterally spaced bearing surfaces of a leading one of said divider sections, moving said transfer apparatus from the first end of said lane divider towards a second end thereof and simultaneously upwardly engaging said transfer apparatus with said bearing surfaces to lift said divider sections as a unit in suspended and spaced relationship above said roadway from said first position adjacent to a first side of said transfer apparatus, conveying said suspended divider sections as a unit serpentine-like generally transversely across said transfer apparatus from said first position towards said second position adjacent to a second side of said transfer apparatus opposite to the first side thereof in response to movement of said transfer apparatus towards the second end of said lane divider, removing said transfer apparatus from engagement beneath said bearing surfaces, and depositing said suspended divider sections as a unit at said second position in free-standing relationship on said roadway.

10. The method of claim 9 wherein each of said lifting and conveying steps comprises straddling, engaging and supporting the T-shaped upper end of said divider sections by two laterally spaced sets of rollers in suspended relationship under said transfer apparatus.

11. A mobile road vehicle comprising a frame, a plurality of roadwheels mounted on said frame, and means mounted on said frame for transferring a roadway lane divider from a first position on a roadway to a laterally displaced second position thereon, said lane divider comprising a plurality of interconnected divider sections positioned in free-standing relationship on said roadway and disposed is closely spaced and tandem relationship relative to each other, each section being sufficiently high to form a crash barrier for automobiles and the like, said means comprising a generally S-shaped conveyor means mounted on said frame for lifting and suspending said divider sections as a unit above said roadway at said first position, moving said suspended divider sections as a unit serpentine-like generally transversely across said frame from said first position towards said second position, and depositing said suspended divider sections as a unit at said second position in free-standing relationship on said roadway, said conveyor means comprising two laterally spaced sets of roller means for straddling, engaging and supporting opposite sides of an upper end of said divider sections.

12. The vehicle of claim 11 wherein the upper end each of said divider sections is T-shaped to define a pair of laterally spaced and longitudinally extending undercut bearing surfaces thereon and said conveyor means further comprises a generally S-shaped support member extending from said first position to said second position and wherein said sets of roller means are mounted on said support member for engaging beneath said bearing surfaces for gradually lifting said divider sections as a unit in suspended relationship beneath said frame.

13. The vehicle of claim 12 wherein said sets of roller means each comprise a plurality of rollers each having a rotational axis extending downwardly away from said support member and positioned on said support member to dispose a roller of a first set of said roller means in upwardly converging relationship relative to an adjacent roller of a second set of said roller means.

* * * * *

UNITED STATES PATENT AND TRADEMARK OFFICE

CERTIFICATE OF CORRECTION

PATENT NO. : 4,500,225

DATED : February 19, 1985

INVENTOR(S) : JOHN P. QUITTNER

It is certified that error appears in the above-identified patent and that said Letters Patent is hereby corrected as shown below:

Col. 1, line 33 change "for form" to --for forming--.

Col. 1, line 51 change "load in end" to --loading end--.

Col. 2, line 43 "the vehicle" to --a vehicle--.

Col. 4, line 32 (claim 10), change "end" to --end--.

Col. 4, line 43 (claim 11) change "is" to --in--.

Col. 4, line 61 (claim 12) after "end" add --of--.

Signed and Sealed this

*Twenty-second* Day of *October 1985*

[SEAL]

*Attest:*

DONALD J. QUIGG

*Attesting Officer*

*Commissioner of Patents and Trademarks—Designate*